US007020605B2

(12) United States Patent
Gao

(10) Patent No.: US 7,020,605 B2
(45) Date of Patent: Mar. 28, 2006

(54) SPEECH CODING SYSTEM WITH TIME-DOMAIN NOISE ATTENUATION

(75) Inventor: Yang Gao, Mission Viejo, CA (US)

(73) Assignee: Mindspeed Technologies, Inc., Newport Beach, CA (US)

( * ) Notice: Subject to any disclaimer, the term of this patent is extended or adjusted under 35 U.S.C. 154(b) by 767 days.

(21) Appl. No.: 09/782,791

(22) Filed: Feb. 13, 2001

(65) Prior Publication Data

US 2002/0035470 A1 Mar. 21, 2002

Related U.S. Application Data

(60) Provisional application No. 60/232,958, filed on Sep. 15, 2000, provisional application No. 60/233,043, filed on Sep. 15, 2000, provisional application No. 60/232,939, filed on Sep. 15, 2000, provisional application No. 60/233,045, filed on Sep. 15, 2000, provisional application No. 60/233,042, filed on Sep. 15, 2000, provisional application No. 60/233,046, filed on Sep. 15, 2000, provisional application No. 60/233,044, filed on Sep. 15, 2002, provisional application No. 60/232,938, filed on Sep. 15, 2000.

(51) Int. Cl.
*G10L 19/14* (2006.01)

(52) U.S. Cl. ..... 704/225; 704/228

(58) Field of Classification Search ..... 704/225–228, 704/233

See application file for complete search history.

(56) References Cited

U.S. PATENT DOCUMENTS

| | | | | |
|---|---|---|---|---|
| 4,630,304 | A * | 12/1986 | Borth et al. | 381/94.3 |
| 4,630,305 | A * | 12/1986 | Borth et al. | 381/94.3 |
| 4,937,873 | A * | 6/1990 | McAulay et al. | 704/265 |
| 5,012,519 | A * | 4/1991 | Adlersberg et al. | 704/226 |
| 5,937,377 | A * | 8/1999 | Hardiman et al. | 704/225 |
| 6,453,289 | B1 * | 9/2002 | Ertem et al. | 704/225 |
| 6,611,800 | B1 * | 8/2003 | Nishiguchi et al. | 704/221 |
| 6,671,667 | B1 * | 12/2003 | Chandran et al. | 704/233 |

* cited by examiner

*Primary Examiner*—W. R. Young
*Assistant Examiner*—Michael N. Opsasnick
(74) *Attorney, Agent, or Firm*—Farjami & Farjami LLP

(57) ABSTRACT

A speech coding system is provided with time-domain noise attenuation. The speech coding system has an encoder operatively connected to a decoder via a communication medium. A preprocessor processes a digitized speech signal from an analog-to-digital converter. Speech coding systems are used to encode and decode a bitstream. Gains from the speech coding are adjusted by a gain factor Gf that provides time-domain background noise attenuation.

68 Claims, 5 Drawing Sheets

SPEECH CODING SYSTEM WITH TIME-DOMAIN NOISE ATTENUATION

CROSS REFERENCE TO RELATED APPLICATIONS

This application is based on Provisional Application Ser. No. 60/232,958 having the title "SPEECH CODING SYSTEM WITH TIME-DOMAIN NOISE ATTENUATION" filed on Sep. 15, 2000. The benefit of the filing date of the Provisional Application is claimed for this application. The following co-pending and commonly assigned U.S. patent applications have been filed on the same day as the provisional application. All of these applications relate to and further describe other aspects of the embodiments disclosed in this application and are incorporated by reference in their entirety.

BACKGROUND OF THE INVENTION

U.S. Patent Application Ser. No. 09/663,242, "SELECTABLE MODE VOCODER SYSTEM," filed on Sep. 15, 2000, and is now U.S. Pat. No. 6,556,996.

U.S. Patent Application Ser. No. 60/233,043, "INJECTING HIGH FREQUENCY NOISE INTO PULSE EXCITATION FOR LOW BIT RATE CELP," filed on Sep. 15, 2000.

U.S. Patent Application Ser. No. 60/232,939, "SHORT TERM ENHANCEMENT IN CELP SPEECH CODING," filed on Sep. 15, 2000.

U.S. Patent Application Ser. No. 60/233,045, "SYSTEM OF DYNAMIC PULSE POSITION TRACKS FOR PULSE-LIKE EXCITATION IN SPEECH CODING," filed on Sep. 15, 2000.

U.S. Patent Application Ser. No. 60/233,042, "SYSTEM FOR AN ADAPTIVE EXCITATION PATTERN FOR SPEECH CODING," filed on Sep. 15, 2000.

U.S. Patent Application Ser. No. 60/233,046, "SYSTEM FOR ENCODING SPEECH INFORMATION USING AN ADAPTIVE CODEBOOK WITH DIFFERENT RESOLUTION LEVELS," filed on Sep. 15, 2000.

U.S. Patent Application Ser. No. 09/663,837, "CODEBOOK TABLES FOR ENCODING AND DECODING," filed on Sep. 15, 2000, and is now U.S. Pat. No. 6,574,593.

U.S. Patent Application Ser. No. 09/662,828, "BIT STREAM PROTOCOL FOR TRANSMISSION OF ENCODED VOICE SIGNALS," filed on Sep. 15, 2000, and is now U.S. Pat. No. 6,581,032.

U.S. Patent Application Ser. No. 60/233,044, "SYSTEM FOR FILTERING SPECTRAL CONTENT OF A SIGNAL FOR SPEECH ENCODING," filed on Sep. 15, 2002.

U.S. Patent Application Ser. No. 09/663,734, "SYSTEM OF ENCODING AND DECODING SPEECH SIGNALS," filed on Sep. 15, 2000, and is now U.S. Pat. No. 6,604,070.

U.S. Patent Application Ser. No. 09/663,002, "SYSTEM FOR SPEECH ENCODING HAVING AN ADAPTIVE FRAME ARRANGEMENT," filed on Sep. 15.

U.S. Patent Application Ser. No. 60/232,938, "SYSTEM FOR IMPROVED USE OF SUBCODEBOOKS," filed on Sep. 15, 2000.

1. Technical Field

This invention relates generally to digital coding systems. More particularly, this invention relates to digital speech coding systems having noise suppression.

2. Related Art

Telecommunication systems include both landline and wireless radio systems. Wireless telecommunication systems use radio frequency (RF) communication. Currently, the frequencies available for wireless systems are centered in frequency ranges around 900 MHz and 1900 MHz. The expanding popularity of wireless communication devices, such as cellular telephones is increasing the RF traffic in these frequency ranges. Reduced bandwidth communication would permit more data and voice transmissions in these frequency ranges, enabling the wireless system to allocate resources to a larger number of users.

Wireless systems may transmit digital or analog data. Digital transmission, however, has greater noise immunity and reliability than analog transmission. Digital transmission also provides more compact equipment and the ability to implement sophisticated signal processing functions. In the digital transmission of speech signals, an analog-to-digital converter samples an analog speech waveform. The digitally converted waveform is compressed (encoded) for transmission. The encoded signal is received and decompressed (decoded). After digital-to-analog conversion, the reconstructed speech is played in an earpiece, loudspeaker, or the like.

The analog-to-digital converter uses a large number of bits to represent the analog speech waveform. This larger number of bits creates a relatively large bandwidth. Speech compression reduces the number of bits that represent the speech signal, thus reducing the bandwidth needed for transmission. However, speech compression may result in degradation of the quality of decompressed speech. In general, a higher bit rate results in a higher quality, while a lower bit rate results in a lower quality.

Modern speech compression techniques (coding techniques) produce decompressed speech of relatively high quality at relatively low bit rates. One coding technique attempts to represent the perceptually important features of the speech signal without preserving the actual speech waveform. Another coding technique, a variable-bit rate encoder, varies the degree of speech compression depending on the part of the speech signal being compressed. Typically, perceptually important parts of speech (e.g., voiced speech, plosives, or voiced onsets) are coded with a higher number of bits. Less important parts of speech (e.g., unvoiced parts or silence between words) are coded with a lower number of bits. The resulting average of the varying bit rates can be relatively lower than a fixed bit rate providing decompressed speech of similar quality. These speech compression techniques lower the amount of bandwidth required to digitally transmit a speech signal.

Noise suppression improves the quality of the reconstructed voice signal and helps variable-rate speech encoders distinguish voice parts from noise parts. Noise suppression also helps low bit-rate speech encoders produce higher quality output by improving the perceptual speech quality. Some filtering techniques remove specific noises. However, most noise suppression techniques remove noise by spectral subtraction methods in the frequency domain. A voice activity detector (VAD) determines in the time-domain whether a frame of the signal includes speech or noise. The noise frames are analyzed in the frequency-domain to determine characteristics of the noise signal. From these characteristics, the spectra from noise frames are subtracted from the spectra of the speech frames, providing a "clean" speech signal in the speech frames.

Frequency-domain noise suppression techniques reduce some background noise in the speech frames. However, the frequency-domain techniques introduce significant speech distortion if the background noise is excessively suppressed. Additionally, the spectral subtraction method assumes noise and speech signals are in the same phase, which actually is not real. The VAD may not adequately identify all the noise frames, especially when the background noise is changing rapidly from frame to frame. The VAD also may show a noise spike as a voice frame. The frequency-domain noise suppression techniques may produce a relatively unnatural sound overall, especially when the background noise is excessively suppressed. Accordingly, there is a need for a noise suppression system that accurately reduces the background noise in a speech coding system.

SUMMARY

The invention provides a speech coding system with time-domain noise attenuation and related method. The gains from linear prediction speech coding are adjusted by a gain factor to suppress background noise. The speech coding system may have an encoder connected to a decoder via a communication medium.

In one aspect, the speech coding system uses frequency-domain noise suppression along with time-domain voice attenuation to further reduce the background noise. After an analog signal is converted into a digitized signal, a preprocessor may suppress noise in the digitized signal using a voice activity detector (VAD) and frequency-domain noise suppression. When the VAD identifies a frame associated with only noise (no speech), a windowed frame including the identified frame of about 10 ms is transformed into the frequency domain. The noise spectral magnitudes typically change very slowly, thus allowing the estimation of the signal to noise ration (SNR) for each subband. A discrete Fourier transformation provides the spectral magnitudes of the background noise. The spectral magnitudes of the noisy speech signal are modified to reduce the noise level according to the estimated SNR. The modified spectral magnitudes are combined with the unmodified spectral phases. The modified spectrum is transformed back to the time-domain. As a result, the preprocessor provides a noise-suppressed digitized signal to the encoder.

The encoder segments the noise-suppressed digitized speech signal into frames for the coding system. A linear prediction coding (LPC) or similar technique digitally encodes the noise-suppressed digitized signal. An analysis-by-synthesis scheme chooses the best representation for several parameters such as an adjusted fixed-codebook gain, a fixed codebook index, a lag parameter, and the adjusted gain parameter of the long-term predictor. The gains may be adjusted by a gain factor prior to quantization. The gain factor Gf may suppress the background noise in the time domain while maintaining the speech signal. In one aspect, the gain factor is defined by the following equation:

$$Gf=1-C\cdot NSR$$

Where NSR is the frame-based noise-to-signal ratio and C is a constant. To avoid possible fluctuation of the gain factor from one frame to the next, the gain factor may be smoothed by a running mean of the gain factor. Generally, the gain factor adjusts the gains in proportion to changes the signal energy. In one aspect, NSR has a value of about 1 when only background noise is detected in the frame. When speech is detected in the frame, NSR is the square root of the background noise energy divided by the signal energy in the frame. C may be in the range of 0 through 1 and controls the degree of noise reduction. In one aspect, the value of C is in the range of about 0.4 through about 0.6. In this range, the background noise is reduced, but not completely eliminated.

The encoder quantizes the gains, which already are adjusted by the gain factor, and other LPC parameters into a bitstream. The bitstream is transmitted to the decoder via the communication medium. The decoder assembles a reconstructed speech signal based on the bitstream parameters. In addition and as an alternative, the decoder may apply the gain factor to decoded gains similarly as the encoder. The reconstructed speech signal is converted to an analog signal or synthesized speech.

The gain factor provides time-domain background noise attenuation. When speech is detected, the gain factor adjusts the gains according to the NSR. When no speech is detected, the gain factor is at the maximum degree of noise reduction. Accordingly, the background noise in the noise frame essentially is eliminated using time-domain noise attenuation. The speech signal spectrum structure essentially is unchanged.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood with reference to the following figures. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Figure 1:
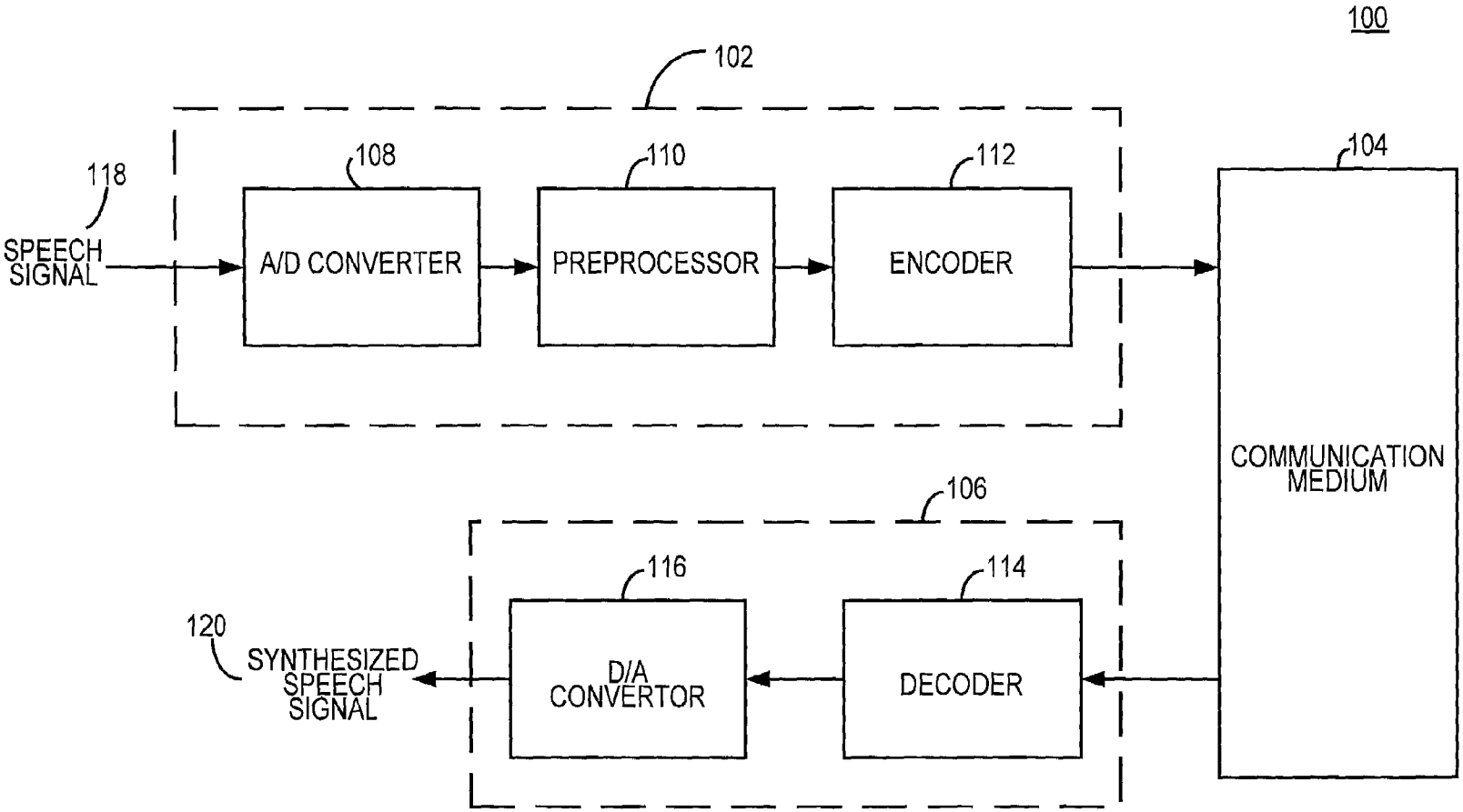
FIG. 1 is a block diagram of a speech coding system with time-domain noise attenuation in the codec.

FIG. 1 is a block diagram of a speech coding system 100 with time-domain noise attenuation. The speech coding system 100 includes a first communication device 102 operatively connected via a communication medium 104 to a second communication device 106. The speech coding system 100 may be any cellular telephone, radio frequency, or other telecommunication system capable of encoding a speech signal 118 and decoding it to create synthesized speech 108. The communication devices 102 and 106 may be cellular telephones, portable radio transceivers, and other wireless or wireline communication systems. Wireline systems may include Voice Over Internet Protocol (VoIP) devices and systems.

The communication medium 104 may include systems using any transmission mechanism, including radio waves, infrared, landlines, fiber optics, combinations of transmission schemes, or any other medium capable of transmitting digital signals. The communication medium 104 may also include a storage mechanism including a memory device, a storage media or other device capable of storing and retrieving digital signals. In use, the communication medium 104 transmits digital signals, including a bitstream, between the first and second communication devices 102 and 106.

The first communication device 102 includes an analog-to-digital converter 108, a preprocessor 110, and an encoder 112. Although not shown, the first communication device 102 may have an antenna or other communication medium interface (not shown) for sending and receiving digital signals with the communication medium 104. The first communication device 102 also may have other components known in the art for any communication device.

The second communication device 106 includes a decoder 114 and a digital-to-analog converter 116 connected as shown. Although not shown, the second communication device 106 may have one or more of a synthesis filter, a postprocessor, and other components known in the art for any communication device. The second communication device 106 also may have an antenna or other communication medium interface (not shown) for sending and receiving digital signals with the communication medium 104.

The preprocessor 110, encoder 112, and/or decoder 114 comprise processors, digital signal processors, application specific integrated circuits, or other digital devices for implementing the algorithms discussed herein. The preprocessor 110 and encoder 112 comprise separate components or a same component.

In use, the analog-to-digital converter 108 receives a speech signal 118 from a microphone (not shown) or other signal input device. The speech signal may be a human voice, music, or any other analog signal. The analog-to-digital converter 108 digitizes the speech signal, providing the digitized speech signal to the preprocessor 110. The preprocessor 110 passes the digitized signal through a high-pass filter (not shown), preferably with a cutoff frequency of about 80 Hz. The preprocessor 110 may perform other processes to improve the digitized signal for encoding, such as noise suppression, which usually is implemented in the frequency domain.

In one embodiment, the preprocessor 110 suppresses noise in the digitized signal. The noise suppression may be done through, a spectrum subtraction technique and any other method to remove the noise. Noise suppression includes time-domain processes and may optionally include frequency domain processes. In one embodiment, the preprocessor 110 has a voice activity detector (VAD) and uses frequency-domain noise suppression. When the VAD identifies a noise only frame (no speech), a windowed frame of about 10 ms is transformed into the frequency domain. The noise spectral magnitudes typically change very slowly, thus allowing the estimation of the signal-to-noise ration (SNR) for each subband. A discrete Fourier transformation provides the spectral magnitudes of the background noise. The spectral magnitudes of the noisy speech signal may be modified to reduce the noise level according to the estimated SNR. The modified spectral magnitudes are combined with the unmodified spectral phases to create a modified spectrum. The modified spectrum then may be transformed back to the time-domain. As a result, the preprocessor 110 provides a noise-suppressed digitized signal to the encoder 112.

The encoder 112 performs time-domain noise suppression and segments the noise-suppressed digitized speech signal into frames to generate a bitstream. In one embodiment, the speech coding system 100 uses frames having 160 samples and corresponding to 20 milliseconds per frame at a sampling rate of about 8000 Hz. The encoder 112 provides the frames via a bitstream to the communication medium 104.

The decoder 114 receives the bitstream from the communication medium 104. The decoder 114 operates to decode the bitstream and generate a reconstructed speech signal in the form of a digital signal. The reconstructed speech signal is converted to an analog or synthesized speech signal 120 by the digital-to-analog converter 116. The synthesized speech signal 120 may be provided to a speaker (not shown) or other signal output device.

The encoder 112 and decoder 114 use a speech compression system, commonly called a codec, to reduce the bit rate of the noise-suppressed digitized speech signal. There are numerous algorithms for speech codecs that reduce the number of bits required to digitally encode the original speech or noise-suppressed digitized signal while attempting to maintain high quality reconstructed speech. The code excited linear prediction (CELP) coding technique utilizes several prediction techniques to remove redundancy from the speech signal. The CELP coding approach is frame-based. Sampled input speech signals (i.e., the preprocessed digitized speech signals) are stored in blocks of samples called frames. The frames are processed to create a compressed speech signal in digital form.

The CELP coding approach uses two types of predictors, a short-term predictor and a long-term predictor. The short-term predictor is typically applied before the long-term predictor. The short-term predictor also is referred to as linear prediction coding (LPC) or a spectral representation and typically may comprise 10 prediction parameters. A first prediction error may be derived from the short-term predictor and is called a short-term residual. A second prediction error may be derived from the long-term predictor and is called a long-term residual. The long-term residual may be coded using a fixed codebook that includes a plurality of fixed codebook entries or vectors. During coding, one of the entries may be selected and multiplied by a fixed codebook gain to represent the long-term residual. The long-term predictor also can be referred to as a pitch predictor or an adaptive codebook and typically comprises a lag parameter and a long-term predictor gain parameter.

The CELP encoder 112 performs an LPC analysis to determine the short-term predictor parameters. Following the LPC analysis, the long-term predictor parameters and the fixed codebook entries that best represent the prediction error of the long-term residual are determined. Analysis-by-synthesis (ABS) is employed in CELP coding. In the ABS approach, synthesizing with an inverse prediction filter and applying a perceptual weighting measure find the best contribution from the fixed codebook and the best long-term predictor parameters.

The short-term LPC prediction coefficients, the adjusted fixed-codebook gain, as well as the lag parameter and the adjusted gain parameter of the long-term predictor are quantized. The quantization indices, as well as the fixed codebook indices, are sent from the encoder to the decoder.

The CELP decoder 114 uses the fixed codebook indices to extract a vector from the fixed codebook. The vector is multiplied by the fixed-codebook gain, to create a fixed codebook contribution. A long-term predictor contribution is added to the fixed codebook contribution to create a synthesized excitation that is commonly referred to simply as an excitation. The long-term predictor contribution comprises the excitation from the past multiplied by the long-term predictor gain. The addition of the long-term predictor contribution alternatively comprises an adaptive codebook contribution or a long-term pitch filtering characteristic. The excitation is passed through a synthesis filter, which uses the LPC prediction coefficients quantized by the encoder to generate synthesized speech. The synthesized speech may be passed through a post-filter that reduces the perceptual coding noise. Other codecs and associated coding algorithms may be used, such as adaptive multi rate (AMR), extended code excited linear prediction (eX-CELP), multi-pulse, regular pulse, and the like.

The speech coding system 100 provides time-domain background noise attenuation or suppression to provide better perceptual quality. The time-domain background noise attenuation may be provided in combination with the frequency-domain noise suppression from the preprocessor 110 in one embodiment. However, the time-domain background noise suppression also may be used without frequency-domain noise suppression.

In one embodiment of the time-domain background noise attenuation, both the unquantized fixed codebook gain and the unquantized long-term predictor gain obtained by the CELP coding approach are multiplied (adjusted) by a gain factor Gf, as defined by the following equation:

$$Gf=1-C\cdot NSR$$

Generally, the gain factor adjustment is proportionate to changes in reduction signal energy. Other, more or fewer gains generated using CELP or other algorithms may be similarly weighted or adjusted.

Typically, NSR has a value of about 1 when only background noise (no speech) is detected in the frame. When speech is detected in the frame, NSR is the square root of the background noise energy divided by the signal energy in the frame. Other formula may be used to determine the NSR. A voice activity detector (VAD) may be used to determine whether the frame contains a speech signal. The VAD may be the same or different from the VAD used for the frequency domain noise suppression.

Generally, C is in the range of 0 through 1 and controls the degree of noise reduction. For example, a value of about 0 comprises no noise reduction. When C is about O, the fixed codebook gain and the long-term predictor gain remain as obtained by the coding approach. In contrast, a C value of about 1 comprises the maximum noise reduction. The fixed codebook gain and the long-term predictor gain are reduced. If the NSR value also is about 1, the gain factor essentially "zeros-out" the fixed codebook gain and the long-term predictor gain. In one embodiment, the value of C is in the range of about 0.4 to 0.6. In this range the background noise is reduced, but not completely eliminated. Thus providing more natural speech. The value of C may be preselected and permanently stored in the speech coding system 100. Alternatively, a user may select or adjust the value of C to increase or decrease the level of noise suppression.

To avoid possible fluctuation of the gain factor from one frame to the next, the gain factor may be smoothed by a running mean of the gain factor. In one embodiment, the gain factor is adjusted according to the following equation:

$$Gf_{new}=\alpha\cdot Gf_{old}+(1-\alpha)\cdot Gf_{current}$$

where $Gf_{old}$ is the gain factor from the preceding frame, $Gf_{current}$ is the gain factor calculated for the current frame, and $Gf_{new}$ is the mean gain factor for the current frame. In one aspect, $\alpha$ is equal to about 0.5. In another respect, a is equal to about 0.25. $Gf_{new}$ may be determined by other equations.

The gain factor provides time-domain background noise attenuation. When speech is detected, the gain factor adjusts the fixed codebook and long-term predictor gains according to the NSR. When no speech is detected, the gain factor is at the maximum degree of noise reduction. While the gain factor noise suppression technique is shown for a particular CELP coding algorithm, other CELP or other digital signal processes may be used with time-domain noise attenuation.

As mentioned, the unquantized fixed codebook gain and the unquantized long-term predictor gain obtained by the CELP coding are multiplied by a gain factor Gf. In one embodiment, the gains may be adjusted by the gain factor prior to quantization by the encoder 112. In addition or as an alternative, the gains may be adjusted after the gains are decoded by the decoder 114 although it is less efficient.

Figure 2:
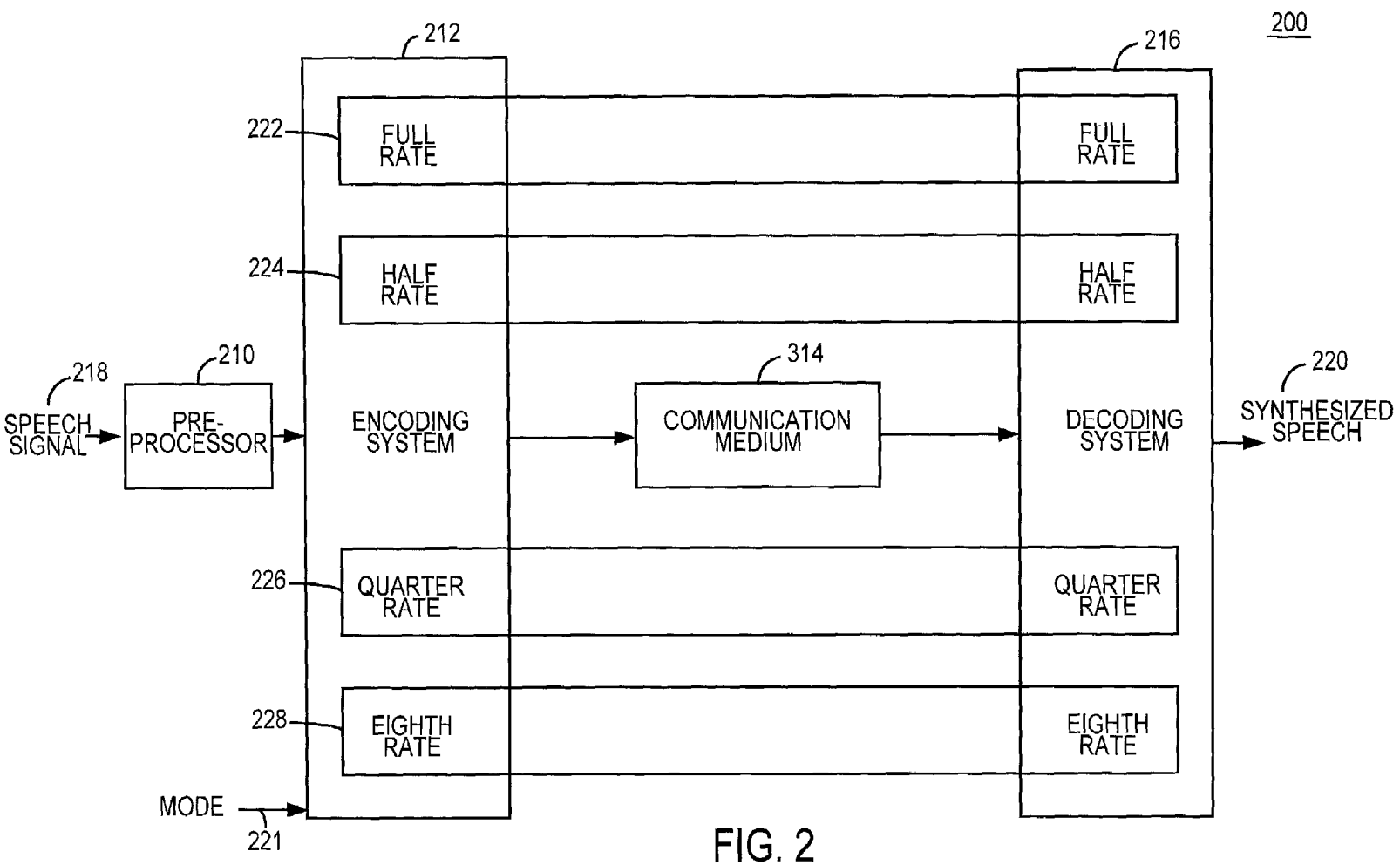
FIG. 2 is another embodiment of a speech coding system with time-domain noise attenuation in the codec.

FIG. 2 shows another embodiment of a speech coding system 200 with time-domain noise attenuation and multiple possible bit rates. The speech coding system 200 includes a preprocessor 210, an encoding system 212, a communication medium 214, and a decoding system 216 connected as illustrated. The speech coding system 200 and associated communication medium 214 may be any cellular telephone, radio frequency, or other telecommunication system capable of encoding a speech signal 218 and decoding the encoded bit stream to create synthesized speech 220. The encoding system 212 and the decoding system 216 each may have an antenna or other communication media interface (not shown) for sending and receiving digital signals.

In use, the preprocessor 210 receives a speech signal 218 from a signal input device such as a microphone. Although shown separately, the preprocessor 210 may be part of the encoding system 212. The speech signal may be a human voice, music, or any other analog signal. The preprocessor 210 provides the initial processing of the speech signal 218, which may include filtering, signal enhancement, noise removal, amplification, and other similar techniques to improve the speech signal 218 for subsequent encoding. In this embodiment, the preprocessor 210 has an analog-to-digital converter (not shown) for digitizing the speech signal 218. The preprocessor 210 passes the digitized signal through a high-pass filter (not shown), preferably with a cutoff frequency of about 80 Hz. The preprocessor 210 may perform other processes to improve the digitized signal for encoding.

In one embodiment, the preprocessor 210 suppresses noise in the digitized signal. The noise suppression may be done through one or more filters, a spectrum subtraction technique, and any other method to remove the noise. In a further embodiment, the preprocessor 210 includes a voice activity detector (VAD) and uses frequency-domain noise suppression as discussed above. As a result, the preprocessor 210 provides a noise-suppressed digitized signal to the encoding system 212.

The speech coding system 200 includes four codecs—a full rate codec 222, a half rate codec 224, a quarter rate codec 226 and an eighth rate codec 228. There may be any number of codecs. Each codec has an encoder portion and a decoder portion located within the encoding and decoding systems 212 and 216, respectively. Each codec 222, 224, 226 and 228 may generate a portion of the bitstream between the encoding system 212 and the decoding system 216. Each codec 222, 224, 226 and 228 generates a different size bitstream, and consequently, the bandwidth needed to transmit bitstreams responsible to each codec 222, 224, 226, and 228 is different. In one aspect, the full rate codec 222, the half rate codec 224, the quarter rate codec 226 and the eighth rate codec 228 each generate about 170 bits, about 80 bits, about 40 bits, and about 16 bits, respectively, per frame. Other rates and more or fewer codecs may be used.

By processing the frames of the speech signal 218 with the various codecs, an average bit rate may be calculated. The encoding system 212 determines which of the codecs 222, 224, 226, and 228 are used to encode a particular frame based on the frame characterization and the desired average bit rate.

Preferably, a Mode line 221 carries a Mode-input signal indicating the desired average bit rate for the bitstream. The Mode-input signal is generated by a wireless telecommunication system, a system of the communication medium 214, or the like. The Mode-input signal is provided to the encoding system 212 to aid in determining which of a plurality of codecs will be used within the encoding system 212.

The frame characterization is based on the portion of the speech signal 218 contained in the particular frame. For example, frames may be characterized as stationary voiced, non-stationary voiced, unvoiced, onset, background noise, and silence.

In one embodiment, the Mode signal identifies one of a Mode 0, a Mode 1, and a Mode 2. The three Modes provide different desired average bit rates that vary the usage of the codecs 222, 224, 226, and 228.

Mode 0 is the "premium mode" in which most of the frames are coded with the full rate codec 222. Some frames are coded with the half rate codec 224. Frames comprising silence and background noise are coded with the quarter rate codec 226 and the eighth rate codec 228.

Mode 1 is the "standard mode" in which frames with high information content, such as onset and some voiced frames, are coded with the full rate codec 222. Other voiced and unvoiced frames are coded with the half rate codec 224. Some unvoiced frames are coded with the quarter rate codec 226 and silence. Stationary background noise frames are coded with the eighth rate codec 228.

Mode 2 is the "economy mode" in which only a few frames of high information content are coded with the full rate codec 222. Most frames are coded with the half rate codec 224, except for some unvoiced frames that are coded with the quarter rate codec 226. Silence and stationary background noise frames are coded with the eighth rate codec 228.

By varying the selection of the codecs, the speech compression system 200 delivers reconstructed speech at the desired average bit rate while maintaining a high quality. Additional modes may be provided in alternative embodiments.

In one embodiment of the speech compression system 200, the full and half-rate codecs 222 and 224 are based on an eX-CELP (extended CELP) algorithm. The quarter and eighth-rate codecs 226 and 228 are based on a perceptual matching algorithm. The eX-CELP algorithm categorizes frames into different categories using a rate selection and a type classification. Within different categories of frames, different encoding approaches are utilized having different perceptual matching, different waveform matching, and different bit assignment. In this embodiment, the perceptual matching algorithm of the quarter-rate codec 226 and the eighth-rate codec 228 do not use waveform matching and instead concentrate on the perceptual embodiments when encoding frames.

The coding of each frame using either the eX-CELP or perceptual matching may be based on further dividing the frame into a plurality of subframes. The subframes may be different in size and number for each codec 222, 224, 226 and 228. With respect to the eX-CELP algorithm, the subframes may be different in size for each category. Within subframes, a plurality of speech parameters and waveforms are coded with several predictive and non-predictive scalar and vector quantization techniques.

The eX-CELP coding approach, like the CELP approach, uses analysis-by-synthesis (ABS) to choose the best representation for several parameters. In particular, ABS is used to choose the adaptive codebook, the fixed codebook, and corresponding gains. The ABS scheme uses inverse prediction filters and perceptual weighting measures for selecting the best codebook entries.

Figure 3:
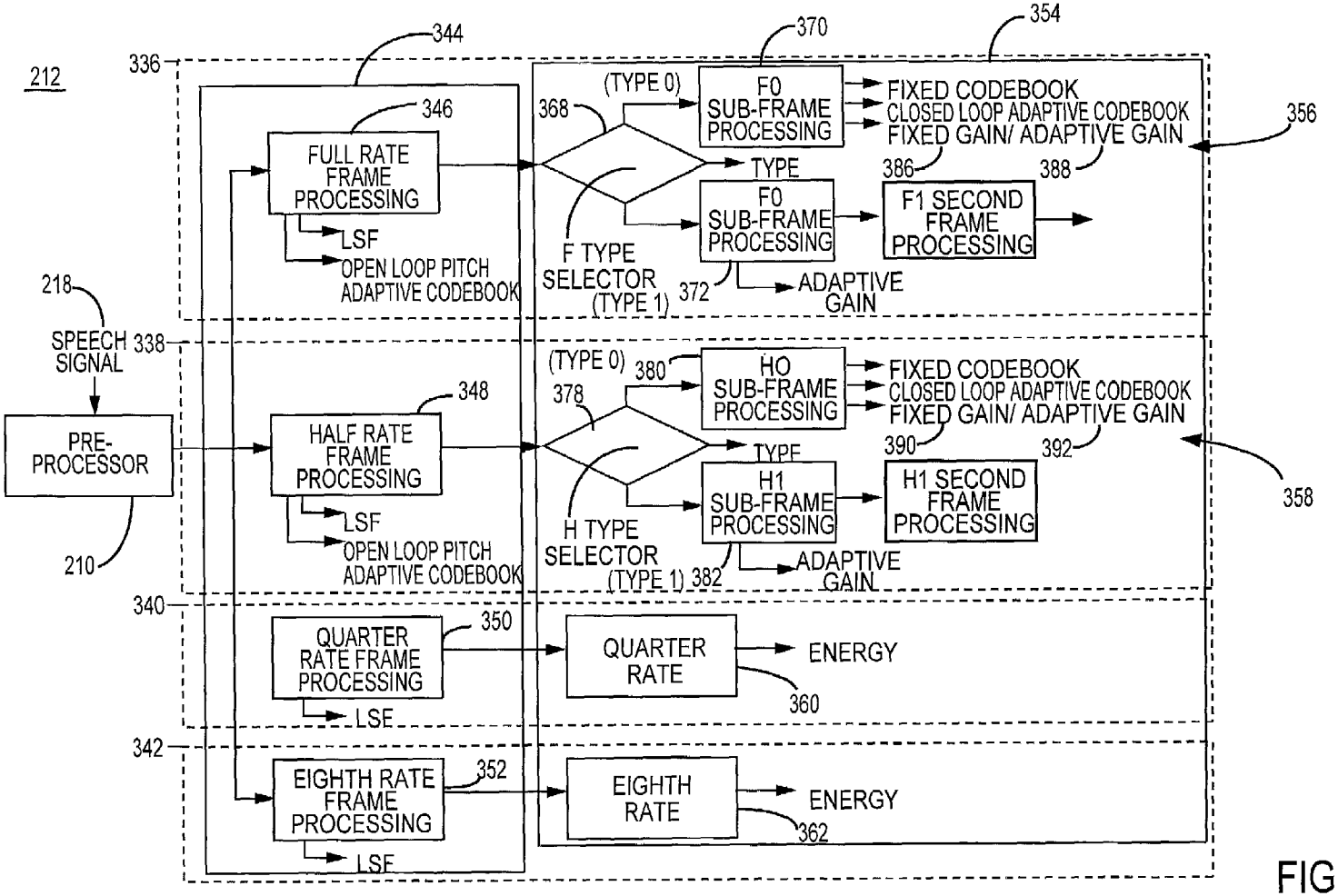
FIG. 3 is an expanded block diagram of an encoding system for the speech coding system shown in FIG. 2.

FIG. 3 is an expanded block diagram of the encoding system 212 shown in FIG. 2. One embodiment of the encoding system 212 includes a full rate encoder 336, a half rate encoder 338, a quarter rate encoder 340, and an eighth rate encoder 342 that are connected as illustrated. The rate encoders 336, 338, 340 and 342 include an initial frame-processing module 344 and an excitation-processing module 354. The initial frame-processing module 344 is illustratively sub-divided into a plurality of initial frame processing modules, namely, an initial full rate frame processing module 346, an initial half rate frame-processing module 348, an initial quarter rate frame-processing module 350 and an initial eighth rate frame-processing module 352.

The full, half, quarter, and eighth rate encoders 336, 338, 340 and 342 comprise the encoding portion of the full, half, quarter and eighth rate codecs 222, 224, 226 and 228, respectively. The initial frame-processing module 344 performs initial frame processing, speech parameter extraction, and determines which rate encoder 336, 338, 340 and 342 will encode a particular frame.

The initial frame-processing module 344 determines a rate selection that activates one of the rate encoders 336, 338, 340 and 342. The rate selection may be based on the categorization of the frame of the speech signal 318 and the mode the speech compression system 200. Activation of one rate encoder 336, 338, 340 and 342 correspondingly activates one of the initial frame-processing modules 346, 348, 350 and 352.

The particular initial frame-processing module 346, 348, 350 and 352 is activated to encode embodiments of the speech signal 18 that are common to the entire frame. The encoding by the initial frame-processing module 344 quantizes some parameters of the speech signal 218 contained in a frame. These quantized parameters result in generation of a portion of the bitstream. In general, the bitstream is the compressed representation of a frame of the speech signal 218 that has been processed by the encoding system 312 through one of the rate encoders 336, 338, 340 and 342.

In addition to the rate selection, the initial frame-processing module 344 also performs particular processing to determine a type classification for each frame that is processed by the full and half rate encoders 336 and 338. In one embodiment, the speech signal 218 as represented by one frame is classified as "type one" or as "type zero" dependent on the nature and characteristics of the speech signal 218. In an alternate embodiment, additional classifications and supporting processing are provided.

Type one classification includes frames of the speech signal 218 having harmonic and formant structures that do not change rapidly. Type zero classification includes all other frames. The type classification optimizes encoding by the initial full rate frame-processing module 346 and the initial half rate frame-processing module 348. In addition, the classification type and rate selection are used by the excitation-processing module 354 for the full and half rate encoders 336 and 338.

In one embodiment, the excitation-processing module 354 is sub-divided into a full rate module 356, a half rate module 358, a quarter rate module 360 and an eighth rate module 362. The rate modules 354, 356, 358 and 360 depicted in FIG. 3 corresponds to the rate encoders 236, 238, 240 and 242 shown in FIG. 2. The full and half rate modules 356 and 358 in one embodiment both include a plurality of frame processing modules and a plurality of subframe processing modules but provide substantially different encoding.

The full rate module 356 includes an F type selector module 368, an F0 subframe processing module 370, and an F1 second frame-processing module 372. The term "F" indicates full rate, and "0" and "1" signify type zero and type one, respectively. Similarly, the half rate module 358 includes an H type selector module 378, an H0 subframe processing module 380, and an H1 second frame-processing module 382. The term "H" indicates half rate.

The F and H type selector modules 368 and 378 direct the processing of the speech signals 318 to further optimize the encoding process based on the type classification. Classification type one indicates the frame contains harmonic and formant structures that do not change rapidly such as stationary voiced speech. Accordingly, the bits used to represent a frame classified as type one are allocated to facilitate encoding that takes advantage of these embodiments. Classification type zero indicates the frame exhibits harmonic and formant structures that change more rapidly. The bit allocation is consequently adjusted to better represent and account for these characteristics.

The F0 and H0 subframe processing modules 370 and 380 generate a portion of the bitstream when the frame being processed is classified as type zero. Type zero classification of a frame activates the F0 or H0 subframe processing modules 370 and 380 to process the frame on a subframe basis. In an embodiment of the present invention, the gain factor, Gf, is used in the subframe processing modules 370 and 380 to provide time-domain noise attenuation as discussed above.

In the full and half subframe processing modules 370 and 380, the fixed codebook gains 386 and 390 and the adaptive codebook gains 388 and 392 are determined. In one embodiment, the unquantized fixed codebook gains 390 and 392 and the unquantized adaptive codebook gains 388 and 392 are multiplied by a gain factor Gf to provide time-domain background noise attenuation.

In one embodiment, these gains are adjusted by the gain factor prior to quantization by the full and half rate encoders 336 and 338. In addition or as an alternative, these gains may be adjusted after decoding by the full and half rate decoders 400 and 402 (see FIG. 4), although it is less efficient. Additionally, the gain factor may be similarly applied to other gains in the eX-CELP algorithm to provide time-domain noise suppression.

To complete the quantization of the bitstream by the encoding system 212, the F1 and H1 second frame-processing modules 372 and 382, generate a portion of the bitstream when the frame being processed is classified as type one. Type one classification involves both subframe and frame processing within the full or half rate modules 356 and 358.

The quarter and eighth rate modules 360 and 362 are part of the quarter and eighth rate encoders 340 and 342, respectively, and do not include the type classification. The quarter and eighth rate modules 360 and 362 generate a portion of the bitstream on a subframe basis and a frame basis, respectively. In quarter or eighth rates, only one gain needs to be adjusted from frame to frame, or subframe to subframe, in order to scale noise excitation.

The rate modules 356, 358, 360 and 362 generate a portion of the bitstream that is assembled with a respective portion of the bitstream generated by the initial frame processing modules 346, 348, 350 and 352. Thus, the encoder 212 creates a digital representation of a frame for transmission via the communication medium 214 to the decoding system 216.

Figure 4:
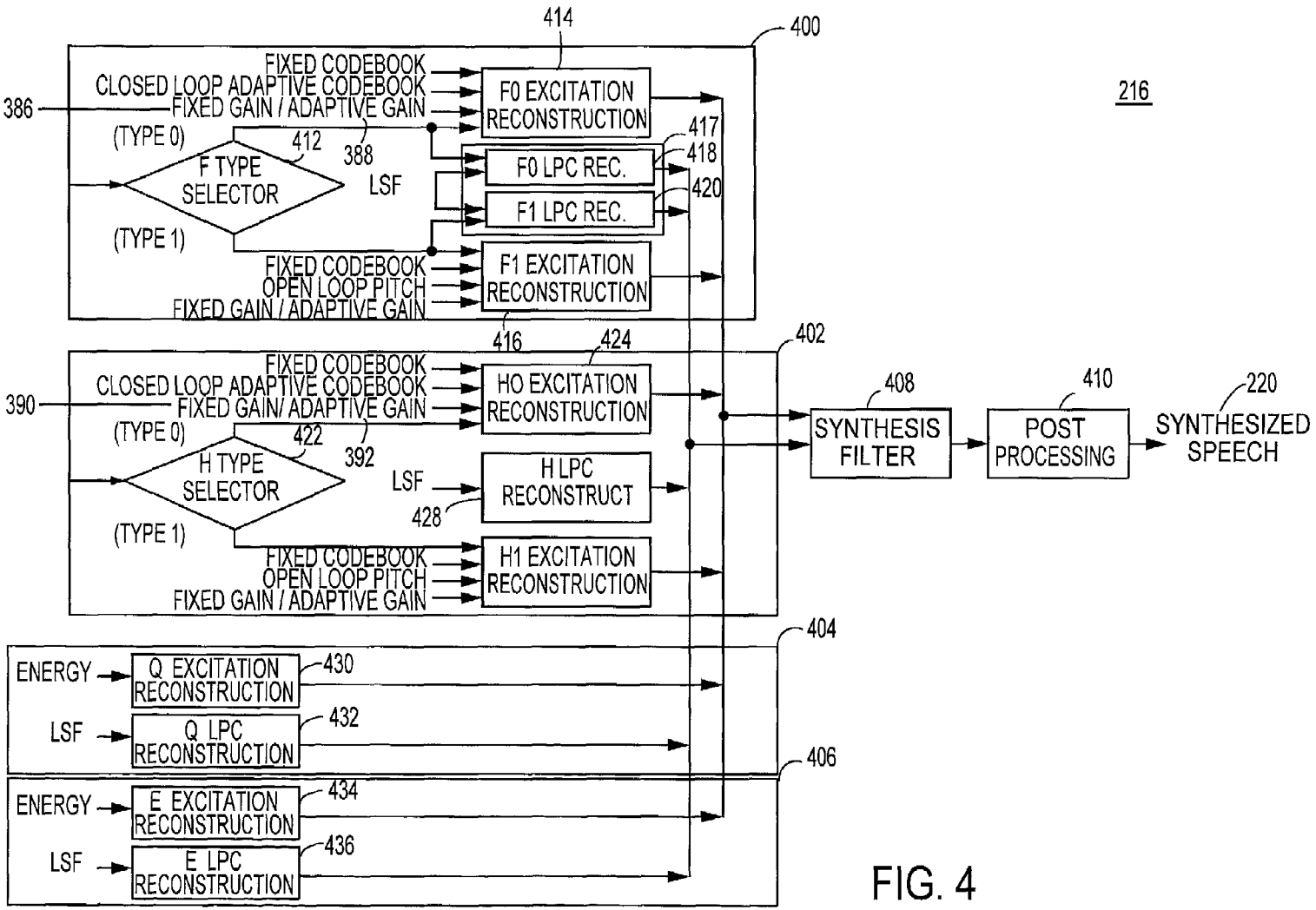
FIG. 4 is an expanded block diagram of a decoding system for the speech coding system shown in FIG. 2.

FIG. 4 is an expanded block diagram of the decoding system 216 illustrated in FIG. 2. One embodiment of the decoding system 216 includes a full rate decoder 400, a half rate decoder 402, a quarter rate decoder 404, an eighth rate decoder 406, a synthesis filter module 408 and a post-processing module 410. The full, half, quarter and eighth rate decoders 400, 402, 404 and 406, the synthesis filter module 408, and the post-processing module 410 are the decoding portion of the full, half, quarter and eighth rate codecs 222, 224, 226 and 228 shown in FIG. 2.

The decoders 400, 402, 404 and 406 receive the bitstream and decode the digital signal to reconstruct different parameters of the speech signal 218. The decoders 400, 402, 404 and 406 decode each frame based on the rate selection. The rate selection is provided from the encoding system 212 to the decoding system 216 by a separate information transmittal mechanism, such as, for example, a control channel in a wireless telecommunication system.

The synthesis filter assembles the parameters of the speech signal 218 that are decoded by the decoders 400, 402, 404 and 406, thus generating reconstructed speech. The reconstructed speech is passed through the post-processing module 410 to create the synthesized speech 220.

The post-processing module 410 may include, for example, filtering, signal enhancement, noise removal, amplification, tilt correction, and other similar techniques capable of decreasing the audible noise contained in the reconstructed speech. The post-processing module 410 is operable to decrease the audible noise without degrading the reconstructed speech. Decreasing the audible noise may be accomplished by emphasizing the formant structure of the reconstructed speech or by suppressing only the noise in the frequency regions that are perceptually not relevant for the reconstructed speech. Since audible noise becomes more noticeable at lower bit rates, one embodiment of the post-processing module 410 provides post-processing of the reconstructed speech differently depending on the rate selection. Another embodiment of the post-processing module 410 provides different post-processing to different groups or ones of the decoders 400, 402, 404 and 406.

One embodiment of the full rate decoder 490 includes an F type selector 412 and a plurality of excitation reconstruction modules. The excitation reconstruction modules comprise an F0 excitation reconstruction module 414 and an F1 excitation reconstruction module 416. In addition, the full rate decoder 409 includes a linear prediction coefficient (LPC) reconstruction module 417. The LPC reconstruction module 417 comprises an F0 LPC reconstruction module 418 and an F1 LPC reconstruction module 420.

Similarly, one embodiment of the half rate decoder 402 includes an H type selector 422 and a plurality of excitation reconstruction modules. The excitation reconstruction modules comprise an H0 excitation reconstruction module 424 and an H1 excitation reconstruction module 426. In addition, the half rate decoder 402 comprises a LPC reconstruction module 428. Although similar in concept, the full and half rate decoders 400 and 402 are designated to only decode bitstreams from the corresponding full and half rate encoders 336 and 338, respectively.

The F and H type selectors 412 and 422 selectively activate respective portions of the full and half rate decoders 400 and 402. A type zero classification activates the F0 or H0 excitation reconstruction modules 414 and 424. The F0 and H0 excitation reconstruction modules 414 and 424 decode or unquantize the fixed and adaptive codebook gains 386, 388, 390 and 392. In addition to or as an alternative to the adjustment of gains in the encoder, the gain factor Gf may be multiplied by the fixed and adaptive codebook gains 386, 388, 390 and 392 in the decoder to provide time-domain noise attenuation.

Conversely, a type one classification activates the F1 or H1 excitation reconstruction modules 416 and 426. The type zero and type one classifications activate the F0 or F1 LPC reconstruction modules 418 and 420, respectively. The H LPC reconstruction module 428 is activated based solely on the rate selection.

The quarter rate decoder 404 includes a Q excitation reconstruction module 430 and a Q LPC reconstruction module 432. Similarly, the eighth rate decoder 406 includes an E excitation reconstruction module 434 and an E LPC reconstruction module 436. Both the respective Q or E excitation reconstruction modules 430 and 434 and the respective Q or E LPC reconstruction modules 432 and 436 are activated based on the rate selection.

During operation, the initial frame-processing module 344 analyzes the speech signal 218 to determine the rate selection and activate one of the codecs 222, 224, 226 and 228. If the full rate codec 222 is activated to process a frame based on the rate selection, the initial full rate frame-processing module 346 may determine the type classification for the frame and may generate a portion of the bitstream. The full rate module 356, based on the type classification, generates the remainder of the bitstream for the frame. The bitstream is decoded by the full rate decoder 400, the synthesis filter 408 and the post-processing module 410 based on the rate selection. The full rate decoder 400 decodes the bitstream utilizing the type classification that was determined during encoding.

Figure 5:
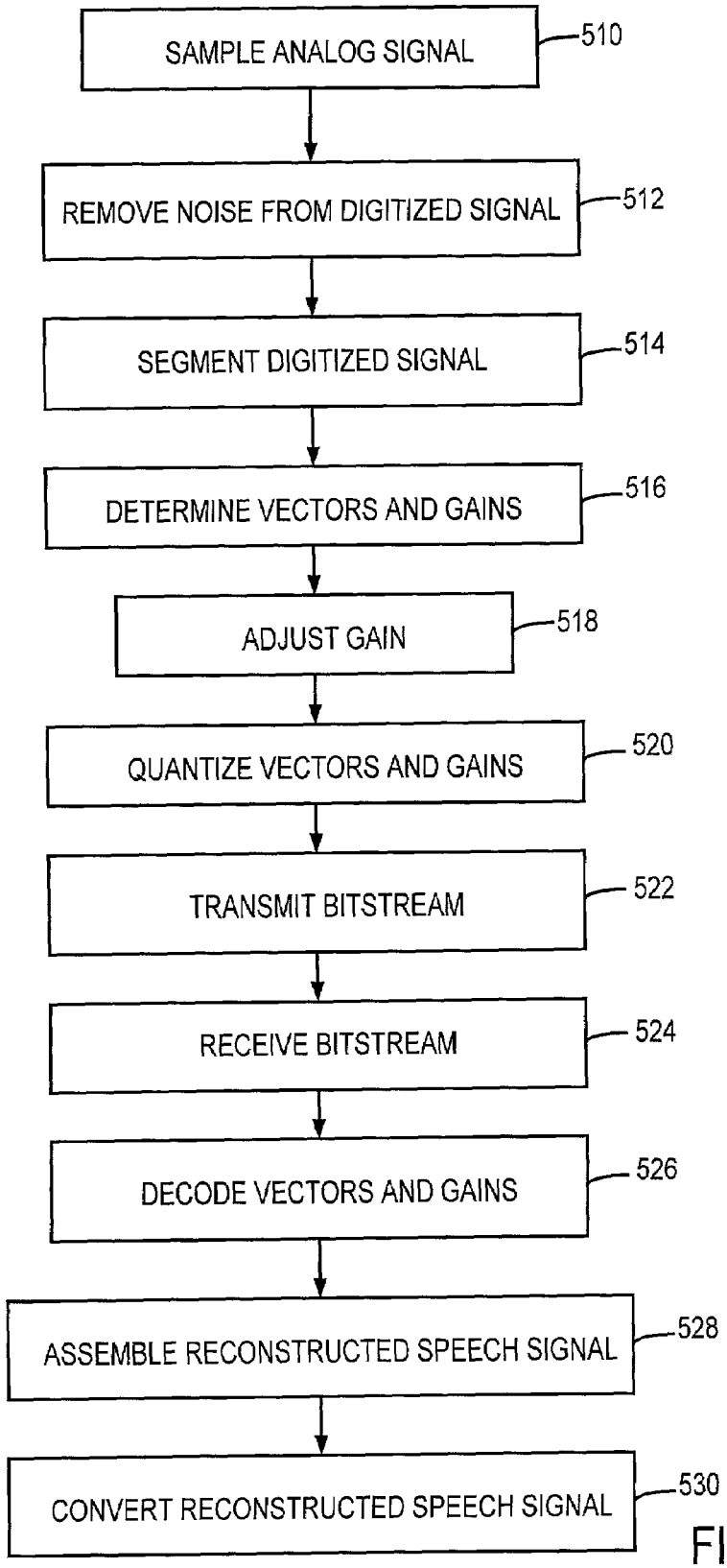
FIG. 5 is a flowchart showing a method of attenuating noise in a speech coding system.

FIG. 5 shows a flowchart of a method for coding speech signals with time-domain noise attenuation. In Act 510, an analog speech signal is sampled to produce a digitized signal. In Act 515, the noise is removed from the digitized signal using a frequency-domain noise suppression technique as previously described. A preprocessor or other circuitry may perform the noise suppression. In Act 520, the digitized signal is segmented into at least one frame using an encoder. In Act 525, the encoder determines at least one vector and at least one gain representing a potion of the digitized signal within the at least one frame. As discussed for FIGS. 1–3, the encoder may use a CLEP, eX-CLEP, or other suitable coding approach to perform Acts 520 and 525. In Act 530, at least one gain is adjusted to attenuate background noise in the at least one frame. The gain is adjusted according to a gain factor based on the following equation:

$$Gf=1-C\cdot NSR$$

or another equation as previously discussed. In Act 535, the encoder quantizes the at least one vector and the at least one gain into a bitstream for transmission in Act 540. In Act 545, a decoder receives the bitstream from a communication medium. In Act 550, the decoder decodes or unquantizes the at least one vector and the at least one gain for assembling into a reconstructed speech signal in Act 555. In Act 560, a digital-to-analog converter receives the reconstructed speech signal and converts it into synthesized speech.

The embodiments discussed in this invention are discussed with reference to speech signals, however, processing of any analog signal is possible. It also is understood that the numerical values provided can be converted to floating point, decimal or other similar numerical representation that may vary without compromising functionality. Further, functional blocks identified as modules are not intended to represent discrete structures and may be combined or further sub-divided in various embodiments. Additionally, the speech coding systems 100 and 200 may be provided partially or completely on one or more Digital Signal Processing (DSP) chips. The DSP chip is programmed with source code. The source code is first translated into fixed point, and then translated into the programming language that is specific to the DSP. The translated source code is then downloaded into the DSP. One example of source code is the C or C++ language source code. Other source codes may be used.

While various embodiments of the invention have been described, it will be apparent to those of ordinary skill in the art that many more embodiments and implementations are possible that are within the scope of this invention. Accordingly, the invention is not to be restricted except in light of the attached claims and their equivalents.

What is claimed is:

1. A speech coding system comprising:

a preprocessor configured to receive a digitized signal from an analog-to-digital converter in time-domain, the preprocessor configured to transform the digital signal into frequency-domain, modify spectral magnitudes of the digitized signal in frequency-domain to generate a noise-reduced digitized signal and transform the noise-reduced digitized signal back to time-domain;

an encoder disposed to receive the noise-reduced digitized signal in time-domain, the encoder to provide a bitstream based upon a speech coding of the noise-reduced digitized signal;

where the speech coding determines at least one gain scaling a portion of the noise-reduced digitized signal; and where the encoder adjusts the at least one gain as a function of noise characteristic for attenuating background noise in at least one frame, wherein the at least one gain is adjusted according to a gain factor, the gain factor facilitating time-domain background noise attenuation.

2. The system according to claim 1, where the speech coding comprises code excited linear prediction (CELP).

3. The system according to claim 1, where the speech coding comprises extended code excited linear prediction (eX-CELP).

4. The system according to claim 1, where the at least one gain is adjusted prior to quantization by the speech coding.

5. The system according to claim 1, where the portion of the digitized signal is one of a frame, a sub-frame, and a half frame.

6. The system according to claim 1, where the encoder comprises a digital signal processing (DSP) chip.

7. The system according to claim 1, further comprising a decoder operatively connected to receive the bitstream from the encoder, the decoder to provide a reconstructed signal based upon the bitstream.

8. The system according to claim 1, where the encoder adjusts the at least one gain according to the gain factor.

9. The system according to claim 8, where the gain factor Gf is determined by the equation, $$Gf=1-C\cdot NSR$$

where NSR has a value of about 1 when the portion comprises essentially background noise, where NSR is the square root of background noise energy divided by signal energy when the portion comprises speech, and where C is in the range of 0 through 1.

10. The system according to claim 9, where C is in the range of about 0.4 through about 0.6.

11. The system according to claim 9, further comprising a voice activity detector (VAD) operatively connected to the encoder, the VAD to determine when the portion comprises speech.

12. The system according to claim 8, where the gain factor is based on a running mean.

13. The system according to claim 12, where the running mean Gf new is determined by the equation, $$Gf_{new}=\alpha\cdot Gf_{old}+(1-\alpha)\cdot Gf_{current}$$

where $Gf_{old}$ is a preceding gain factor for a preceding portion of the digitized signal, where $Gf_{current}$ is the gain factor based on the portion of the digitized signal, and where $0\leqq\alpha<1$.

14. The system according to claim 13, where $\alpha$ is equal to about 0.5.

15. A speech coding system comprising:

a decoder disposed to receive a bitstream, the decoder to provide a reconstructed signal based upon a speech decoding of the bitstream;

where the speech decoding determines at least one gain scaling a portion of the reconstructed signal wherein the decoder adjusts the at least one gain as a function of noise characteristic for attenuating background noise in at least one frame and generating a background noise attenuated signal, and wherein the at least one gain is adjusted according to a gain factor, the gain factor facilitating time-domain background noise attenuation; and a postprocessor configured to receive the background noise attenuated signal in time-domain, the postprocessor configured to transform the background noise attenuated signal into frequency-domain, modify spectral magnitudes of the background noise attenuated signal in frequency-domain to generate a noise-reduced attenuated signal and transform the noise-reduced attenuated signal back to time-domain.

16. The system according to claim 15, where the speech decoding comprises code excited linear prediction (CELP).

17. The system according to claim 15, where the speech decoding comprises extended code excited linear prediction (eX-CELP).

18. The system according to claim 15, where the at least one gain is adjusted after decoding by the speech decoding.

19. The system according to claim 15, where the portion of the reconstructed signal is one of a frame, a sub-frame, and a half frame.

20. The system according to claim 15, where the decoder comprises a digital signal processing (DSP) chip.

21. The system according to claim 15, further comprising an encoder operatively connected to provide the bitstream to the decoder.

22. The system according to claim 15, where the decoder adjusts the at least one gain according to the gain factor.

23. The system according to claim 22, where the gain factor Gf is determined by the equation, $$Gf=1-C\cdot NSR$$

where NSR has a value of about 1 when the portion comprises essentially background noise, where NSR is the square root of background noise energy divided by signal energy when the portion comprises speech, and where C is in the range of 0 through 1.

24. The system according to claim 23, where C is in the range of about 0.4 through about 0.6.

25. The system according to claim 23, further comprising a voice activity detector (VAD) operatively connected to the decoder, the VAD to determine when the portion comprises speech.

26. The system according to claim 22, where the gain factor is based on a running mean.

27. The system according to claim 26, where the running mean $Gf_{new}$ is determined by the equation, $$Gf_{new}=\alpha\cdot Gf_{old}+(1-\alpha)\cdot Gf_{current}$$

where $Gf_{old}$ is a preceding gain factor for a preceding portion of the reconstructed signal, where $Gf_{current}$ is the gain factor based on the portion of the reconstructed signal, and where $0\leqq\alpha<1$.

28. The system according to claim 27, where $\alpha$ is equal to about 0.5.

29. A speech coding system comprising:

a preprocessor configured to receive a digitized signal from an analog-to-digital converter in time-domain, the preprocessor configured to transform the digital signal into frequency-domain, modify spectral magnitudes of the digitized signal in frequency-domain to generate a noise-reduced digitized signal and transform the noise-reduced digitized signal back to time-domain;

an encoder disposed to receive a the noise-reduced digitized signal, the encoder to provide a bitstream based upon a speech coding of the noise-reduced digitized signal, where the speech coding determines at least one gain scaling a portion of the digitized signal, and where the encoder adjusts the at least one gain as a function of noise characteristic; and a decoder operatively connected to receive the bitstream from the encoder, where the decoder provides a reconstructed signal based upon a speech decoding of the bitstream, where the speech decoding reconstructs the at least one gain scaling the portion of the digitized signal, and where the decoder adjusts the at least one gain as a function of noise characteristic for attenuating background noise in at least one frame and generating a background noise attenuated signal, wherein the at least one gain is adjusted according to a gain factor, the gain factor facilitating time-domain background noise attenuation.

30. The system according to claim 29, where the speech coding and the speech decoding comprise code excited linear prediction (CELP).

31. The system according to claim 29, where the speech coding and the speech decoding comprise extended code excited linear prediction (eX-CELP).

32. The system according to claim 29, where at least one of the encoder and the decoder adjusts the at least one gain.

33. The system according to claim 29, where the portion of the digitized signal is one of a frame, a sub-frame, and a half frame.

34. The system according to claim 29, further comprising:

a postprocessor configured to receive the background noise attenuated signal in time-domain, the postprocessor configured to transform the background noise attenuated signal into frequency-domain, modify spectral magnitudes of the background noise attenuated signal in frequency-domain to generate a noise-reduced attenuated signal and transform the noise-reduced attenuated signal back to time-domain.

35. The system according to claim 29, where at least one of the encoder and the decoder comprises a digital signal processing (DSP) chip.

36. The system according to claim 29, where at least one of the encoder and the decoder adjusts the gain according to a gain factor.

37. The system according to claim 36, where the gain factor Gf is determined by the equation, $$Gf=1-C\cdot NSR$$

where NSR has a value of about 1 when the portion comprises essentially background noise, where NSR is the square root of background noise energy divided by signal energy when the portion comprises speech, and where C is in the range of 0 through 1.

38. The system according to claim 37, where C is in the range of about 0.4 through about 0.6 when one of the encoder and the decoder adjusts the gain by the gain factor.

39. The system according to claim 37, where C is in the range of about 0.2 though about 0.4 when the encoder and the decoder adjust the gain by the gain factor.

40. The system according to claim 37, further comprising a voice activity detector (VAD) operatively connected to at least one of the encoder and the decoder, the VAD to determine when the portion comprises speech.

41. The system according to claim 36, where the gain factor is based on a running mean.

42. The system according to claim 41, where the running mean $Gf_{new}$ is determined by the equation, $$Gf_{new}=\alpha\cdot Gf_{old}+(1-\alpha)\cdot Gf_{current}$$

where $Gf_{old}$ is a preceding gain factor for a preceding portion of the digitized signal, where $Gf_{current}$ is the gain factor based on the portion of the digitized signal, and where $0\leqq\alpha<0$.

43. The system according to claim 42, where $\alpha$ is equal to about 0.5.

44. A method of speech coding comprising:

receiving a digitized signal in time-domain;

transforming the digital signal into frequency-domain;

modifying spectral magnitudes of the digitized signal in frequency-domain to generate a noise-reduced digitized signal;

transforming the noise-reduced digitized signal back to time-domain;

segmenting the noise-reduced digitized signal into at least one portion;

determining at least one gain scaling the noise-reduced digitized signal within the one portion;

adjusting the at least one gain as a function of noise characteristic; and quantizing the at least one gain into a group of at least one bit for a bitstream, where the at least one gain is adjusted as a function of noise characteristic for attenuating background noise in at least one frame, wherein the at least one gain is adjusted according to a gain factor, the gain factor facilitating time-domain background noise attenuation.

45. The method of claim 44, where the portion is one of a frame, a sub-frame, and a half frame.

46. The method of claim 44, where the speech coding system comprises code excited linear prediction (CELP).

47. The method of claim 44, where the speech coding system comprises extended code excited linear prediction (eX-CELP).

48. The method of claim 44, where the adjusting further comprises adjusting the at least one gain according to the gain factor.

49. The method of claim 48, where the gain factor Gf is determined by the equation $$Gf=1-C\cdot NSR$$

where NSR has a value of about 1 when the portion comprises essentially background noise, where NSR is the square root of background noise energy divided by signal energy when the portion comprises speech, and where C is in the range of 0 through 1.

50. The method of claim 48, where the gain factor is based on a running mean.

51. The method of claim 50, where the running mean $Gf_{new}$ is determined by the equation, $$Gf_{new}=\alpha\cdot Gf_{old}+(1-\alpha)\cdot Gf_{current}$$

where $Gf_{old}$ is a preceding gain factor for a preceding portion of the digitized signal, where $Gf_{current}$ is the gain factor based on the portion of the digitized signal, and where $0\leqq\alpha<1$.

52. The method of claim 51, where $\alpha$ is equal to about 0.5.

53. A method of speech coding comprising:

decoding at least one gain from a group of at least one bit in a bitstream;

adjusting the at least one gain as a function of noise characteristic;

assembling the at least one gain into a portion of a reconstructed speech signal, where the at least one gain is adjusted as a function of noise characteristic for attenuating background noise in at least one frame and generating a background noise attenuated signal in time-domain, and wherein the at least one gain is adjusted according to a gain factor, the gain factor facilitating time-domain background noise attenuation;

transforming the background noise attenuated signal into frequency-domain;

modifying spectral magnitudes of the background noise attenuated signal in frequency-domain to generate a noise-reduced attenuated signal; and transforming the noise-reduced attenuated signal back to time-domain.

54. The method of claim 53, where the speech coding system comprises code excited linear prediction (CELP).

55. The method of claim 53, where the speech coding system comprises extended code excited linear prediction (eX-CELP).

56. The method of claim 53, where the adjusting further comprises adjusting the at least one gain according to the gain factor.

57. The method of claim 56, where the gain factor Gf is determined by the equation $$Gf=1-C\cdot NSR$$

where NSR has a value of about 1 when the portion comprises essentially background noise, where NSR is the square root of background noise energy divided by signal energy when the portion comprises speech, and where C is in the range of 0 through 1.

58. The method of claim 56, where the gain factor is based on a running mean.

59. The method of claim 58, where the running mean $Gf_{new}$ is determined by the equation, $$Gf_{new}=\alpha\cdot Gf_{old}+(1-\alpha)\cdot Gf_{current}$$

where $Gf_{old}$ is a preceding gain factor for a preceding portion of the digitized signal, where $Gf_{current}$ is the gain factor based on the portion of the digitized signal, and where $0\leqq\alpha<1$.

60. The method of claim 59, where $\alpha$ is equal to about 0.5.

61. A method of speech coding comprising:

receiving a digitized signal in time-domain;

transforming the digital signal into frequency-domain;

modifying spectral magnitudes of the digitized signal in frequency-domain to generate a noise-reduced digitized signal;

transforming the noise-reduced digitized signal back to time-domain;

segmenting the noise-reduced digitized signal into at least one portion;

determining at least one gain representing the noise-reduced digitized signal within the one portion;

pre-adjusting the at least one gain as a function of noise characteristic;

quantizing the at least one gain into a group of at least one bit for a bitstream.

decoding the at least one gain from the group of at least one bit in the bitstream;

post-adjusting the at least one gain as a function of noise characteristic; and assembling the at least one gain into a reconstructed speech signal, where the at least one gain is adjusted as a function of noise characteristic for attenuating background noise in at least one frame, wherein the at least one gain is adjusted according to a gain factor, the gain factor facilitating time-domain background noise attenuation.

62. The method of claim 61, where the speech coding system comprises code excited linear prediction (CELP).

63. The method of claim 61, where the speech coding system comprises extended code excited linear prediction (eX-CELP).

64. The method of claim 61, where at least one of the pre-adjusting and the post-adjusting further comprises adjusting the at least one gain according to the gain factor.

65. The method of claim 64, where the gain factor Gf is determined by the equation $$Gf=1-C\cdot NSR$$

where NSR has a value of about 1 when the portion comprises essentially background noise, where NSR is the square root of background noise energy divided by signal energy when the portion comprises speech, and where C is in the range of 0 through 1.

66. The method of claim 64, where the gain factor is based on a running mean.

67. The method of claim 66, where the running mean $Gf_{new}$ is determined by the equation, $$Gf_{new}=\alpha\cdot Gf_{old}+(1-\alpha)\cdot Gf_{current}$$

where $Gf_{old}$ is a preceding gain factor for a preceding portion of the digitized signal, where $Gf_{current}$ is the gain factor based on the portion of the digitized signal, and where $0\leqq\alpha<0$.

68. The method of claim 67, where $\alpha$ is equal to about 0.5.

* * * * *